United States Patent [19]

Ruggieri, Jr.

[11] 3,930,336

[45] Jan. 6, 1976

[54] WINDOW CONSTRUCTION

[76] Inventor: Nicola Ruggieri, Jr., 44 Rhode Island St., Cranston, R.I. 02920

[22] Filed: Oct. 15, 1974

[21] Appl. No.: 515,099

[52] U.S. Cl. ..... 49/161; 292/274; 292/278

[51] Int. Cl.[2] ..... E05D 15/22

[58] Field of Search ..... 49/161, 176, 187, 354; 292/262, 270, 274, 278

[56] References Cited

UNITED STATES PATENTS 1,414,595 5/1922 Snyder ..... 292/27 UX 2,659,943 11/1953 Polson et al. ..... 49/187 X

*Primary Examiner*—Kenneth Downey

*Attorney, Agent, or Firm*—Salter & Michaelson

[57] ABSTRACT

A window construction comprising vertically slidable and tiltable sash members having means for positively maintaining the tiltable sash in a partially-tilted position.

1 Claim, 5 Drawing Figures

WINDOW CONSTRUCTION

BACKGROUND AND SUMMARY OF THE INVENTION

Windows embodying sash members which are both vertically slidable and tiltable are extremely well known in the art, as exemplified, for example, by Rodriguez U.S. Pat. No. 3,464,157 dated Sept. 2, 1969; Weidner et al. U.S. Pat. No. 3,434,236, dated Mar. 25, 1969; and Woodhams U.S. Pat. No. 3,091,005 dated May 28, 1963.

In windows of this general type, it has been found that the pivotal mounting for the sash members permits them to be swung to an open position to facilitate cleaning and maintenance, as well as permitting maximum entry of air. In windows of this type, it is often desirable to tilt one of the sashes to a partially-open position, since such a position permits some degree of ventilation, but at the same time prevents the undersirable entry of rain, wind or the like. Obviously, if the sashes are slidably open to a small degree, suitable ventilation will be obtained, but rain, wind and the like will be free to enter through the exposed opening. Accordingly, it is quite common when a person is leaving one's home for an extended period of time for that person to tilt one of the sashes to a partially-open position, which position permits some entry of outside air to effect some degree of ventilation within the house, while at the same time effectively blocking undersirable entry of rain, wind or the like should a storm suddenly arise during the person's absence.

In most pivoted sash-type windows, some degree of frictional drag exists during tilting movement of the sashes. For example, the sashes will frequently have resilient weatherstripping along the outer edges of the vertical side stiles, which weatherstripping effects a frictional drag on the sash as it is swung to an open position. This frictional drag is not enough to impede tilting movement of the sashes, but it is sufficient to frictionally maintain the sashes in any desired open position. The problem that arises, however, is that where a pivoted sash is tilted to a partially-open position to permit ventilation but at the same time block undesirable entry of rain, wind or the like, the frictional retention of the window in its partially-tilted position is not strong enough to withstand the forces exerted by excessive rain, wind or the like; whereby, depending upon the direction of the wind, rain or the like, the partially-open window will either be slammed shut, thus closing off all ventilation and perhaps damaging the window by the sudden impact, or else the window will be forced to swing to a completely open position wherein undesirable entry of the rain, wind or the like is no longer blocked. When this happens in an unattended house, severe damage can obviously result.

The present invention overcomes the above problem by providing conveniently accessible means on the sash which may be selectively moved to an operative position to positively lock the sash in a partially-tilted position. The means for effecting this comprise an elongated strap, preferably of flexible metal, pivotally carried by the horizontal stile of the sash that swings to open position. More specifically, when the sash has been swung to its partially-open position, the aforesaid strap may easily be pivoted to its operative position wherein it extends generally perpendicular to the stile on which it is mounted, and then the free end of the strap is provided with means for interengaging a fixed portion of the window construction whereby the partially-open sash is firmly and positively held in its partially-open position. When it is desired to close the sash or swing it further open, the end of the strap is quickly and easily manually disengaged and is then pivoted to its inoperative position wherein it extends longitudinally of the stile on which it is mounted.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
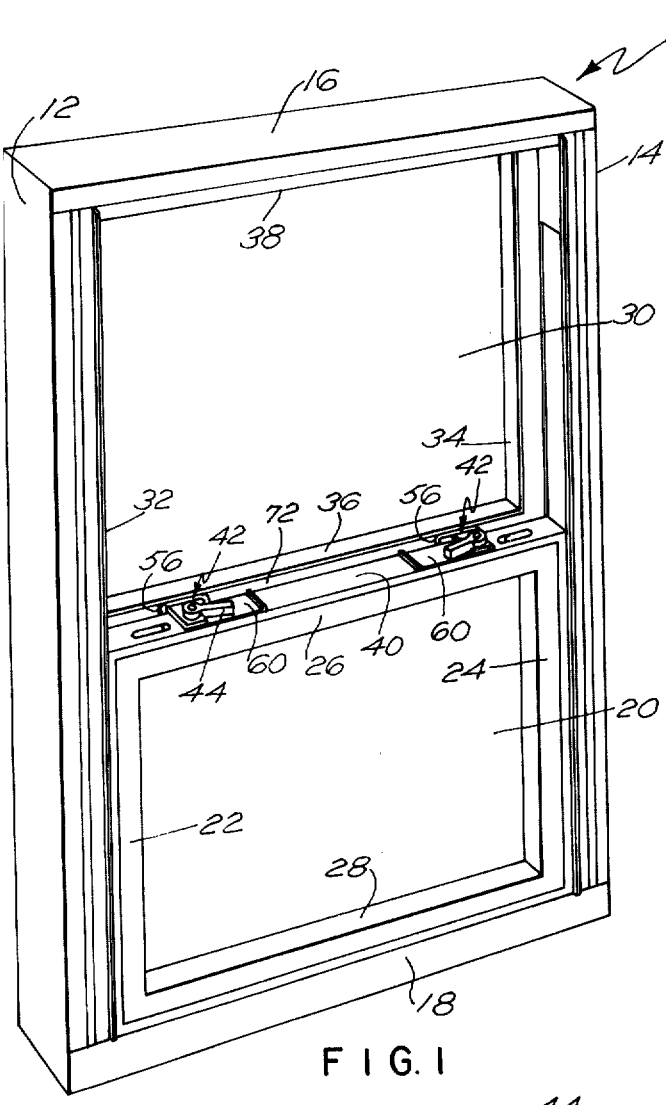
FIG. 1 is a perspective view showing a pivoted sash-type window embodying the present invention of the type with which the instant invention is concerned.

Referring now to the drawings, there is shown generally at 10 a window construction comprising side frames 12, 14, top frame 16, and bottom frame 18. Mounted within said frame members for vertical sliding movement is a lower sash 20 comprising vertically extending side stiles 22, 24, top stile 26, and bottom stile 28. Similarly mounted within the frame members is upper sash 30 consisting of side stiles 32, 34, bottom stile 36, and top stile 38. It will be understood that the sashes 20 and 30 are mounted for vertical sliding movement within the outer frame of window 10 by any suitable conventional means; and it will be further understood that lower sash 20 is pivotally hung, i.e., is tiltable to an open position, also by conventional and well-known means. Upper sash 30 may likewise be pivotally mounted.

Figure 3:
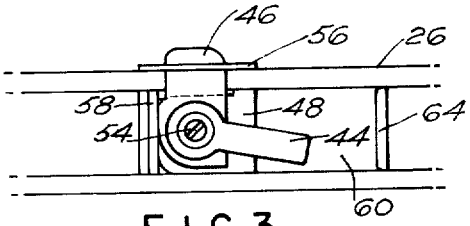
FIG. 3 is a fragmentary top plan view showing the strap member of the present invention in inoperative position.

The top surface 40 of upper stile 26 of lower sash 20 is provided with a pair of pivotally mounted latch members 42, each of which comprises a handle portion 44 and a latch portion 46 extending generally perpendicular therefrom. Base plates 48 are mounted on top surface 40, each base plate 48 having an upwardly extending collar or bushing 50 which rotatably receives one of the latch members 42 by extending through opening 52 in the latter. A screw 54 extends through opening 52 into bushing 50 to maintain latch member 42 rotatably assembled to base plate 48, the latter being mounted on top surface 40 by any suitable means, and preferably in a specially provided recess in top surface 40. Lower stile 36 carries a pair of bail-like retaining members 56, each of which is adapted to receive latch portion 46 when latch member 42 is swung to its operative, locking position, as illustrated in FIG. 3. Base member 48 is provided with a raised flange 58 which functions to limit swinging movement of latch member 42 and specifically limits opening movement of said latch member at a point where latch portions 46 are properly aligned with retaining members 56. It will therefore be seen that when it is desired to lock the upper and lower sashes against vertical sliding movement, it is simply necessary to swing latch members 42 from the inoperative position illustrated in FIG. 4 to the operative position illustrated in FIG. 3 wherein latch portions 46 extend through retaining members 56 to effect the desired lock. This locking arrangement is conventional and per se forms no part of my invention.

Figure 2:
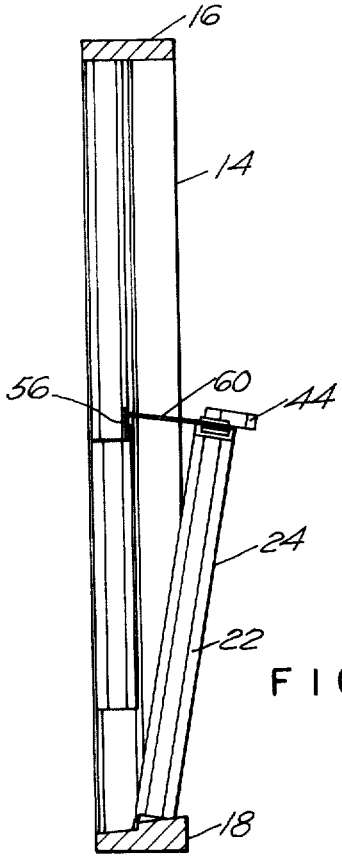
FIG. 2 is a side elevational view showing the sash in partially-open position, a portion of the frame having been removed for purposes of illustration.
Figure 4:
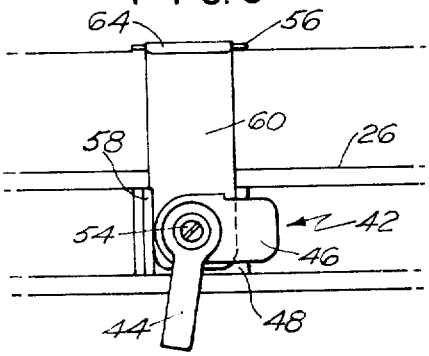
FIG. 4 is a fragmentary plan view showing the strap member of the present invention in operative position.

Pivotally mounted on bushings 50 are a pair of elongated strap members 60, each of said members having an opening 62 therein rotatably receiving bushing 50. At its opposite extremity, each strap member 60 is provided with an integral hook-like extremity 64. Strap member 60 is preferably of flexible metallic construction. As will be noted, strap member 60 is rotatably mounted on the top of base member 48, whereby it is actually sandwiched between said base member and latch member 42. When sash 20 is in a position where strap member 60 is not to be used, such as when the sash member is completely closed, as illustrated in FIG. 1, or when it is completely open, strap member 60 is pivoted to the position illustrated in FIGS. 1 and 3 wherein said strap member extends longitudinally along upper stile 26. When, however, it is desired to use strap member 60 to firmly and securely hold sash 20 in a partially-open position, as illustrated in FIG. 2, the strap members are swung until they extend substantially perpendicularly from stile 26, as illustrated in FIG. 4. In this position, the hook-like end 64 of strap members 60 may be manually engaged with retaining members 56, it being understood that the resilience of the strap members permits them to be forced downwardly sufficiently for the hook-like ends to be passed through the members 56, after which the inherent resilience of the members 60 will urge the members upwardly, and then sash 20 is moved outwardly a slight bit to effect the desired interengagement of portions 56 and 64. It will be seen that the strap members 60 positively prevent both opening and closing movement of sash 20 from the position illustrated in FIG. 2 when the strap member is in its operative position, since said strap member directly resists further outward movement of the sash, while inward movement of the sash is restricted by the end of the hook-like portion 64 engaging the inner surface of bottom stile 36. It will be noted that flange 58 also limits pivotal movement of strap member 60, just as it limits opening swinging movement of latch members 42.

Figure 5:
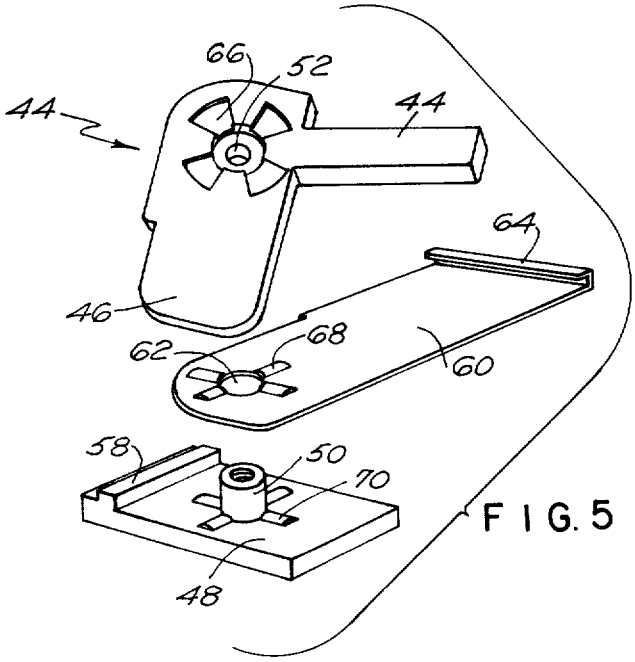
FIG. 5 is a perspective exploded view showing certain components that make up the present invention.

As will be seen most clearly in FIG. 5, latch member 42, strap member 60, and base member 48 are provided with integral detents 66, 68, 70, respectively, said detents functioning to resist inadvertent opening movement of latch member 42 from its locking position illustrated in FIG. 3.

It will be understood that the bail-like retaining members 56 are mounted on the inner surface of stile 36, such as by being mounted on an inwardly extending ledge (not shown) at the bottom of said stile. It will be obvious that even though the retaining members 56 are secured to stile 36, they must be slightly spaced from the inner surface 72 thereof in order to provide sufficient clearance for latch portion 46 to extend through members 56, as illustrated in FIG. 3, and also to provide sufficient clearance to permit interengagement of hook portion 64 with said retaining members. As previously stated, strap member 60 is preferably of metallic construction whereby the hook-like portion 64 thereof will have sufficient strength to resist any force that may tend to further open sash 20. The members 42 and 48 may be of molded plastic.

It will therefore be seen that I have provided extremely simple means for effectively and yet securely maintaining a pivoted sash in partially-tilted position, which means may easily be swung to an inoperative position when not in use, in which position they are not only unobtrusive but also have no effect whatsoever on the conventional operation of the window. Conversely, when it is desired to utilize the members 60, they quickly and easily may be swung to their outwardly extending operative position wherein the hook-like end 64 may quickly and easily be interengaged with the bail-like retaining members 56 to quickly and securely maintain the sash in its partially-tilted position.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A window construction comprising upper and lower sashes slidably mounted in a surrounding jamb, each sash comprising a pair of spaced side stiles and upper and lower stiles extending therebetween, said lower sasy being pivotally mounted for tilting movement to an open position, latch means mounted on the top surface of the upper stile of said lower sash, and bail-like retaining means mounted on the lower stile of said upper sash, means pivotally mounting said latch means for movement between a first inoperative position and a second position wherein said latch means interengage said retaining means to lock said sashes against vertical sliding movement, and means for limiting the tilting movement of said lower sash, said limiting means comprising a strap member having one end pivotally mounted on the top surface of the upper stile of said lower sash by the same aforesaid means that pivotally mount said latch means thereon, whereby said strap member may be selectively pivotally moved between an inoperative position wherein it extends longitudinally along said upper stile, to an operative position wherein it extends perpendicularly from said upper stile, said strap member being of flexible metallic construction and having a hook-like extremity adapted to releasably interengage with said bail-like retaining member when the strap is in its operative position to limit tilting movement of said lower sash, and means on said upper stile for limiting pivoting movement of said strap member to a position approximately perpendicular to said upper stile whereby to facilitate and expedite alignment of said strap member with said retaining means.

* * * * *